US008811842B2

(12) United States Patent
Hase et al.

(10) Patent No.: US 8,811,842 B2
(45) Date of Patent: Aug. 19, 2014

(54) FIXING DEVICE AND IMAGE FORMING APPARATUS

(75) Inventors: Takamasa Hase, Kanagawa Prefecture (JP); Masanao Ehara, Kanagawa Prefecture (JP); Kenji Ishii, Kanagawa Prefecture (JP); Tadashi Ogawa, Tokyo (JP); Satoshi Ueno, Tokyo (JP); Hiroshi Seo, Kanagawa Prefecture (JP); Takahiro Imada, Kanagawa Prefecture (JP); Shuutaroh Yuasa, Kanagawa Prefecture (JP)

(73) Assignee: Ricoh Company, Ltd., Tokyo (JP)

( * ) Notice: Subject to any disclaimer, the term of this patent is extended or adjusted under 35 U.S.C. 154(b) by 204 days.

(21) Appl. No.: 12/974,852

(22) Filed: Dec. 21, 2010

(65) Prior Publication Data

US 2011/0150518 A1 Jun. 23, 2011

(30) Foreign Application Priority Data

Dec. 22, 2009 (JP) ..... 2009-290483

(51) Int. Cl.
*G03G 15/20* (2006.01)

(52) U.S. Cl.
USPC ..... 399/70

(58) Field of Classification Search
USPC ..... 399/70
See application file for complete search history.

(56) References Cited

U.S. PATENT DOCUMENTS 5,832,354 A 11/1998 Kouno et al.
5,915,147 A 6/1999 Kouno et al.
6,219,520 B1 4/2001 Ehara
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.

(Continued)

FOREIGN PATENT DOCUMENTS

JP 2006-259683 9/2006
JP 3949644 4/2007

(Continued)

OTHER PUBLICATIONS

Machine translation of Saito.*

(Continued)

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

The fixing device using an electromagnetic induction heating (IH) method includes a fixing sleeve having a heating layer, a pressure roller to form a nip while contacting the fixing roller and rotate to drive the fixing sleeve, a temperature detector to detect a temperature on a circumference of the fixing sleeve, and an excitation coil provided near the fixing sleeve and configured to perform induction heating of the heating layer of the fixing sleeve based on the detection result from the temperature detector. The fixing device is configured to change a rotation speed of the fixing sleeve in a standby time during which the fixing sleeve, while rotating, is controlled to be heated so as to maintain a target temperature when a periodic temperature difference occurs on a circumference of the fixing rotary member and having a fluctuation amplitude larger than a predetermined value compared to the target temperature.

7 Claims, 7 Drawing Sheets

(56) References Cited

U.S. PATENT DOCUMENTS

| | | | | |
|---|---|---|---|---|
| 6,813,464 | B2 | 11/2004 | Amita et al. | |
| 6,881,927 | B2 | 4/2005 | Yoshinaga et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,266,336 | B2 | 9/2007 | Ueno et al. | |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 2002/0158063 | A1* | 10/2002 | Kawase | 219/619 |
| 2005/0041990 | A1* | 2/2005 | Sugiyama | 399/49 |
| 2006/0029411 | A1 | 2/2006 | Ishii et al. | |
| 2006/0257183 | A1 | 11/2006 | Ehara et al. | |
| 2007/0014600 | A1 | 1/2007 | Ishii et al. | |
| 2007/0110466 | A1* | 5/2007 | Yamaji | 399/69 |
| 2007/0242988 | A1 | 10/2007 | Seo et al. | |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0317532 | A1 | 12/2008 | Ehara et al. | |
| 2009/0123201 | A1 | 5/2009 | Ehara et al. | |
| 2009/0148204 | A1 | 6/2009 | Yoshinaga et al. | |
| 2009/0148205 | A1 | 6/2009 | Seo et al. | |
| 2009/0245897 | A1 | 10/2009 | Seo et al. | |
| 2009/0297197 | A1 | 12/2009 | Hase | |
| 2009/0310996 | A1* | 12/2009 | Kanou | 399/69 |
| 2010/0061753 | A1 | 3/2010 | Hase | |
| 2010/0074667 | A1 | 3/2010 | Ehara et al. | |
| 2010/0158553 | A1 | 6/2010 | Ueno | |
| 2011/0052237 | A1 | 3/2011 | Yoshikawa et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064502 | A1 | 3/2011 | Hase et al. | |

FOREIGN PATENT DOCUMENTS

| | | | |
|---|---|---|---|
| JP | 2007279454 | A * | 10/2007 |
| JP | 2008015235 | A * | 1/2008 |
| JP | 2009-116040 | | 5/2009 |

OTHER PUBLICATIONS

Machine translation of Ueno.*

U.S. Appl. No. 12/893,361, filed Sep. 29, 2010, Hasegawa, et al.

U.S. Appl. No. 12/841,593, filed Jul. 22, 2010, Masaaki Yoshikawa, et al.

* cited by examiner

FIXING DEVICE AND IMAGE FORMING APPARATUS

CROSS-REFERENCE TO RELATED APPLICATIONS

The present application claims priority from Japanese patent application number 2009-290483, filed on Dec. 22, 2009, the entire contents of which are hereby incorporated by reference herein.

BACKGROUND OF THE INVENTION

1. Field of the Invention

The present invention relates to a fixing device using electromagnetic induction heating method and an electrophotographic or electrostatic image forming apparatus such as a fax, a printer, a copier and a multi-function apparatus combining the above functions equipped with the fixing device.

2. Description of the Related Art

A fixing device using an electromagnetic induction heating method (IH method) is configured such that electromagnetic fluxes are generated by causing a high frequency current to flow to an excitation coil or an IH coil, whereby a heat-generated member is induction-heated. According to this structure, the heating member is directly heated, which compares favorably to a heat roller fixing method requiring preheating. In addition, the heating member can be immediately heated and raised to a predetermined temperature, thereby reducing a warm-up time and attaining power saving.

On the other hand, the fixing device is designed to have a lower thermal capacity, and in the IH method, in which a fixing roller is heated from outside, the temperature of the fixing roller in the circumferential direction thereof tends to fluctuate. That is, periodic temperature change or fluctuation amplitude in temperature ripples tends to occur at a certain point in a nip portion. Since a recording medium absorbs heat when passing through the nip, the temperature change is decreased. However, when the fixing roller is heated and rotated in a state where there is no sheet to be passed in a predetermined standby mode, the temperature difference becomes pronounced. Starting the sheet passing operation in this state might result in uneven glossiness or hot offset in the resulting formed image.

In order to solve the above problem, JP-2006-259683-A and JP-3949644-B disclose a method in which the temperature detector is provided upstream of the IH coil in the rotation direction so that the temperature detecting position and the heating position are aligned with each other based on a relation between a rotation speed and a control response speed.

However, in high-productivity image forming apparatuses, the rotation speed of the fixing roller is very high, and there are cases in which the apparatuses cannot provide an adequate control response speed. In general, the control response speed of the IH method requires 200 msec, depending on the calculation process. If the rotation speed is 2 rps or more, the fixing roller rotates more than 140 degrees in that 200 msec. In this case, from the layout design-related difficulties, the temperature detector and the IH coil cannot be separated by 140 degrees or more, and the problem of temperature difference in the above-described fixing roller cannot be solved.

SUMMARY OF THE INVENTION

Accordingly, the present invention provides a novel fixing device using the electromagnetic induction method and is capable of restricting fluctuations in the temperature ripples on the fixing roller and stably controlling the temperature of the fixing roller during a standby period without sheet passing operation to keep the temperature constant while heating and rotating the fixing roller, and a novel image forming apparatus provided with such a fixing device.

As an embodiment of the present invention, the fixing device includes a fixing rotary member having a heating layer; a pressure rotary member configured to form a nip while contacting the fixing rotary member and rotate to drive the fixing rotary member; a temperature detector to detect a temperature on a circumference of the fixing rotary member; and an excitation coil provided near the fixing rotary member and configured to induction-heat the heating layer of the fixing rotary member based on the detection result of the temperature detector. The fixing device is controlled to change a rotation speed of the fixing rotary member when a periodic temperature difference occurs, on a circumference of the fixing rotary member, having a fluctuation amplitude larger than a predetermined value compared to a target temperature.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

A fixing device and an image forming apparatus according to one embodiment of the present invention will now be described.

Figure 1:
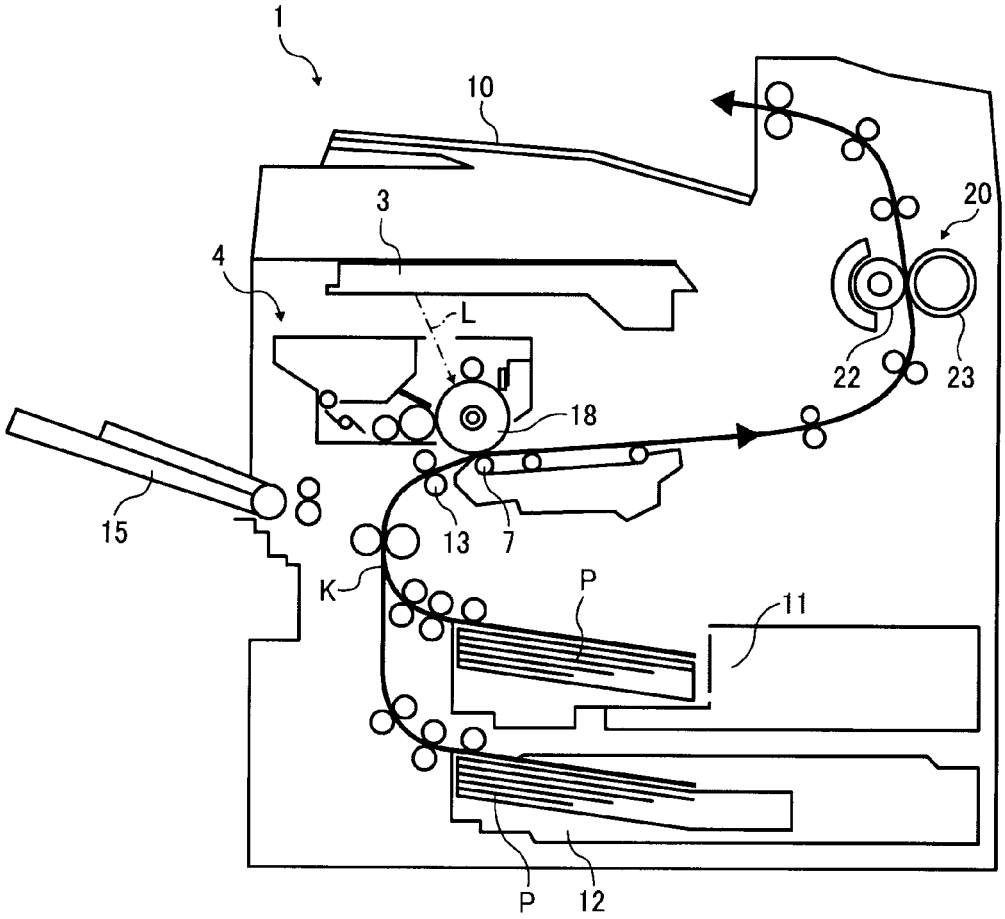
FIG. 1 shows a general configuration of an image forming apparatus according to one embodiment of the present invention.

FIG. 1 shows a structure and operation of the image forming apparatus. The image forming apparatus herein is a laser printer, and includes an apparatus body 1, an exposure section 3, a process cartridge 4, a transfer section 7, a sheet discharge tray 10, sheet feed sections 11 and 12, a manual sheet feeder 15, and a fixing device 20. Based on image information, the exposure section 3 radiates exposure light L onto a photoreceptor drum 18; the process cartridge 4 serves as an image forming section detachably provided to the apparatus body 1; the transfer section 7 transfers a toner image formed on the photoreceptor drum 18 to a recording medium P; the sheet discharge tray 10 serves as a tray on which recording media carrying output image thereon are stacked; the sheet feed sections 11 and 12 serve to contain recording media P such as transfer sheets and the like; the manual sheet feeder 15 is used to feed a recording medium P having a different size from those contained in the sheet feed sections 11 and 12; and the fixing device 20 serves to fix an unfixed image on the recording medium P.

Referring to FIG. 1, a normal image forming operation to be performed in the image forming apparatus will now be described.

First, the exposure light L such as laser beams based on the image information is projected from the exposure section 3 (writing section) onto the photoreceptor drum 18 of the process cartridge 4. The photoreceptor drum 18 rotates in the counterclockwise direction in FIG. 1, and a toner image corresponding to image information is formed on the photoreceptor drum 18 via predetermined imaging processes including a charging process, exposure process, developing process, and the like.

Thereafter, the toner image formed on the photoreceptor drum 18 is transferred to the recording medium P in the transfer section 7 conveyed and aligned by a pair of registration rollers 13.

As for the recording medium P conveyed to the transfer section 7, first, one of the plurality of sheet feed sections 11 and 12 in the image forming apparatus 1 is selected automatically or manually. Here, the uppermost sheet feed section 11 is assumed to be selected. Each of the plurality of sheet feed sections 11 and 12 contain the recording media P having a different size from each other or the recording media P having the same size but provided along a different conveyance direction.

Then, the topmost sheet among the recording media P contained in the sheet feed section 11 is conveyed toward a conveyance path K. Thereafter, the recording medium P reaches a position of the registration roller pair 13 after having passed the conveyance path K. The recording medium P which has reached the position of the registration roller pair 13 is then transferred to the transfer section 7 in synch with the toner image formed on the photoreceptor drum 18.

Then, the recording medium P after the transfer process passes through the position of the transfer section 7 and the conveyance path K and reaches the fixing device 20. The recording medium P, which has reached the fixing device 20, is inserted between a fixing sleeve 22 and a pressure roller 23, also called a nip. The toner image is fixed by heat from the fixing sleeve 22 and pressure from the pressure roller 23. The recording medium P on which the toner image has been fixed is sent from the nip between the fixing sleeve 22 and the pressure roller 23 and is discharged as an output image from the apparatus body of the image forming apparatus 1, onto the sheet discharge tray 10, and a single image forming sequence terminates. It should be noted that although the present image forming apparatus 1 is for monochrome printing, full-color printing is also possible by providing process cartridges 4 for four colors C, M, Y, and K.

Figure 2:
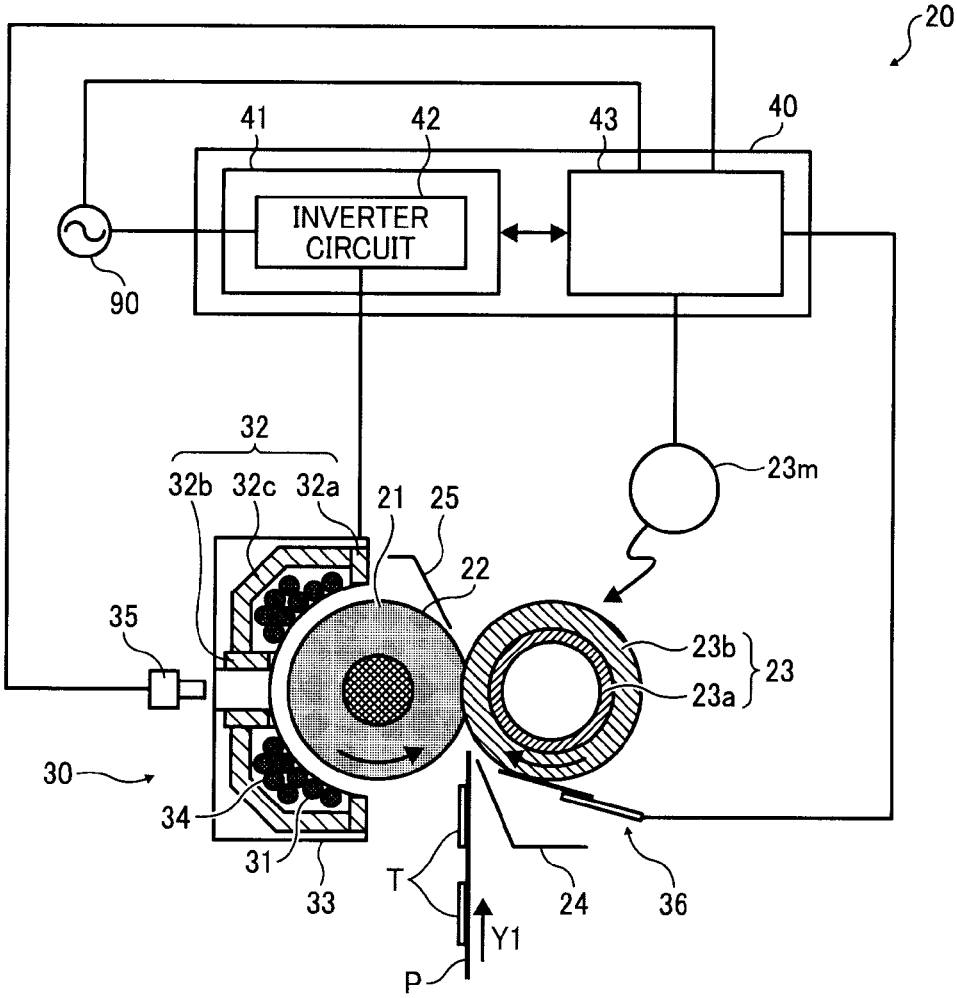
FIG. 2 is a general configuration of a fixing device included in the image forming apparatus of FIG. 1.
Figure 3:
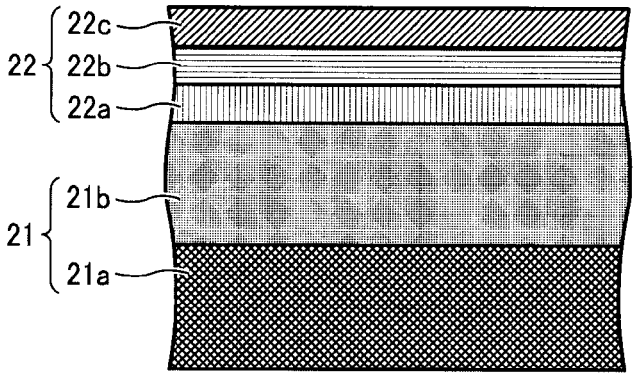
FIG. 3 is a cross-sectional view showing a structure of a fixing sleeve and a fixing roller for use in the fixing device of FIG. 2.

Referring to FIGS. 2 and 3, a configuration and operation of the fixing device 20 according to one embodiment of the present invention will now be described in detail.

As illustrated in FIG. 2, the fixing device 20 includes an induction heating unit 30 as a magnetic flux generating means, a fixing sleeve 22 as a heat generating member, a fixing roller 21 as a support member, a pressure roller 23, and the like.

The fixing sleeve 22 serving as the heat generating member includes a base 22*a* formed of a metallic material having a thickness of 30 to 50 μm, an intermediate heat-resistant elastic layer 22*b*, and an outermost release layer 22*c*, of which the latter two members are sequentially formed on the base 22*a* in this order. The outer diameter of the fixing sleeve 22 is 40 mm. See FIG. 3.

Preferred materials for the base 22*a* in the fixing sleeve 22 include magnetic metals such as iron, cobalt, nickel, or a metal alloy of those materials.

The heat-resistance layer 22*b* is formed of an elastic material such as a silicon rubber and has a thickness of 150 μm so that the thermal capacity is not so large and an optimal image without uneven image fixation may be obtained.

The release layer 22*c* is formed of a tube-like coating of a fluorine compound such as Perfluoro alkoxy alkane (PFA). The thickness of the coating is 50 μm. The release layer improves releasing property of toner deposited on the surface of the fixing sleeve 22, which the toner image directly contacts.

As illustrated in FIG. 3, the fixing roller 21 as a support member includes a metal core 21*a* and an elastic layer 21*b* formed on the metal core 21*a*. The metal core 21*a* has a cylinder shape and is formed of metallic material such as a stainless steel. The elastic layer 21*b* is formed of foamed silicon and has an outer diameter of approximately 40 mm. The elastic layer 21 has a thickness of 9 mm and has a hardness on an axis of 30 to 50 degrees on the Asker C hardness scale. The fixing roller 21 contacts an inner surface of the fixing sleeve 22 and supports the fixing sleeve 22 being formed of a thin layer on a roller shape.

The pressure roller 23 includes a roller metal core 23*a* made of a highly thermally conductive metal material such as aluminum or copper, an intermediate heat-resistant elastic layer 23*b* made of a silicon rubber or the like, and an outermost release layer, not shown, which are sequentially provided in this order to have an outer diameter of 40 mm (see FIG. 2). Here, the heat-resistant elastic layer 23*b* has a thickness of 2 mm. In addition, the release layer is coated with a PFA tube and has a thickness of 50 μm. The pressure roller 23 is pressed against the fixing roller 21 via the fixing sleeve 22. The press-contacted portion forms a nip portion. The recording medium P is conveyed to this nip portion.

The induction heating unit 30 as the magnetic flux generating means is formed of excitation coils 31, degaussing coils 34, a core part 32, a coil guide or coil housing 33, and the like (see FIG. 2).

The coil guide 33 is arranged to cover a part of the outer circumference of the fixing sleeve 22. Each of the excitation coils 31 is provided in an elongated manner on the coil guide 33 in the widthwise direction (being perpendicular to a surface of the paper on which FIG. 2 is drawn) and is formed of litz wires, each being a bundle of thin wires.

Each of the degaussing coils 34 is arranged symmetrically to the width direction of the recording medium and is overlaid on the excitation coil 31. Ends of degaussing coils 34 symmetrically provided are connected with a conducting cable to form a current circuit. Ends of each degaussing coil 34 are connected to a relay, not shown, outside the fixing device 20 to form a closed circuit. In this case, the relay is controlled to turn on and off by a control circuit and turns on and off the current flow to the degaussing coils 34.

The coil guide 33 is formed of a resin material with high heat resistance and supports the excitation coils 31 and the degaussing coils 34.

A core portion 32 is formed of a highly magnetic material such as ferrite having a relative permeability of approximately 2500, and includes a side core 32*a*, a center core 32*b*, and an arch core 32*c*, to effectively form magnetic fluxes toward the fixing sleeve 22. In addition, the core portion 32 is provided to face the excitation coils 31 provided in the elongated manner in the widthwise direction.

The induction heating unit 30 is so provided as to induction-heat a certain area of the fixing sleeve 22 in the circumferential direction. As illustrated in FIG. 2, the induction heating unit 30 is provided to cover almost one half of the circumference of the fixing sleeve 22 opposite the nip portion where the fixing sleeve 22 contacts the pressure roller 23.

A pressure thermistor 36 as a first temperature detecting means is provided to detect a temperature of the pressure roller 23 by contacting the roller surface of the pressure roller 23. The pressure thermistor 36 detects a surface temperature of the pressure roller 23, thereby detecting heat accumulation state of the fixing device 20.

A fixing thermopile 35 as a second temperature detecting means is provided at a predetermined position in the circumferential direction of the fixing sleeve 22 to detect a temperature of the fixing sleeve 22 in a non-contact manner. This fixing thermopile 35 can detect a heating status of the fixing sleeve 22 heated by the induction heating unit 30. Thus, the fixing thermopile 35 is preferably provided in an area of the fixing sleeve 22 heated by the induction heating unit 30 and at a center portion in the circumferential direction of the heated area as illustrated in FIG. 2.

The thus-configured fixing device 20 operates as follows.

A driving motor 23*m* for the pressure roller 23 drives the pressure roller 23 to rotate in the counterclockwise direction in FIG. 2, thereby rotating the fixing sleeve 22 in the clockwise direction. In this case, the fixing roller 21 supporting the fixing sleeve 22 is not driven to rotate swiftly. The fixing sleeve 22 as a heating and fixing member is provided opposite the induction heating unit 30 and is heated by magnetic fluxes radiated from the induction heating unit 30.

Specifically, each excitation coil 31 receives high-frequency alternating current of 10 kHz to 1 MHz (more preferably, 20 kHz to 800 kHz) from a power source, not shown, whereby magnetic force lines are formed to be bidirectionally alternating in the vicinity of the fixing sleeve 22 facing the excitation coil 31. The alternating electric field formation causes the base 22*a* (heat generating layer) of the fixing sleeve 22 to generate eddy current and joule heat due to the electrical resistance, and the base 22*a* is induction-heated. Thus, the fixing sleeve 22 is heated by the induction heating of the base 22*a*.

The surface of the fixing sleeve 22 heated by the induction heating unit 30 reaches the nip portion between the fixing sleeve 22 and the pressure roller 23. An unfixed toner image T on the recording medium P to be conveyed is heated and fused.

More specifically, the recording medium P on which the toner image T is carried though the imaging process is inserted into a portion between the fixing sleeve 22 and the pressure roller 23 while being guided by a guide plate 24 in the direction of arrow Y1. The toner image T is fixed on the recording medium P by the heat received from the fixing sleeve 22 and the pressure received by the pressure roller 23, is separated from the fixing sleeve 22 by a separation plate 25, and is sent out from the nip portion. The surface of the fixing sleeve 22 which has passed through the nip portion turns to reach again a position opposite the induction heating unit 30.

When small-sized sheets are passed in the continuous printing operation, the degaussing coils 34 generate a magnetic field in a direction opposite to that of the excitation coils 31 due to the short-circuit caused by the turned on relay. Thus, the magnetic field of an area in which the degaussing coils 34 are provided decreases and the joule heat generation at the non-sheet passing area of the fixing sleeve 22 is restricted.

Such a series of operations is continuously repeated, and the fixing process in the image forming process is completed.

The fixing device 20 further includes a fixing control unit 40 to control various operations in the fixing device 20 (see FIG. 2). For example, a fixing controller 43 provided inside the fixing control unit 40 controls driving of a drive motor 23*m* for the pressure roller 23 such that the pressure roller 23 and the fixing sleeve 22 rotate at a predetermined speed and the recording medium P is conveyed at a predetermined speed.

As a structure to control heating in the fixing control unit 40, the fixing control unit 40 controls power supply to the induction heating unit 30. For example, the IH controller 41, connected to the induction heating unit 30, is provided with the inverter circuit 42 and is connected to the fixing controller 43 as the control means. The fixing controller 43 is connected to the pressure thermistor 36 configured to detect temperature of the pressure roller 23 and to the fixing thermopile 35 configured to detect temperature of the fixing sleeve 22. Further, the IH controller 41 and the fixing controller 43 are connected to a commercial power supply 90 (of for example 100 volts and 15 amperes).

Here, the fixing controller 43 includes, as control modes for the IH controller 41 supplying power to the excitation coils 31 of the induction heating unit 30, two control modes: a power supply control mode and a temperature control mode. The power supply control mode is used in a warming-up period from when the fixing device 20 is cooled down at a certain degree until when the fixing process is enabled. In this case, power supply to the excitation coils 31 needs to be performed with a predetermined power and preferably a maximum power supply to the fixing device 20 is needed. The temperature control mode is used in the image forming process including fixing process and in a standby mode of the apparatus. The power supply to the excitation coils 31 in this mode is determined by a difference between the temperature of the fixing member such as the fixing sleeve 22 detected by the fixing thermopile 35 and a target temperature for the fixing sleeve 22, and proportional integral derivative (PID) feedback control when supplying power to the excitation coils 31 is to be performed preferably. The PID control includes the proportional integral control and proportional derivative control.

In addition, the fixing controller 43 selectively switches the control mode between the power supply control mode and the temperature control mode and performs controls on flows of electric current to the excitation coils 31. Specifically, the fixing controller 43, upon receiving a signal to start power supply to the excitation coils 31 of the induction heating unit 30, selects the power supply control mode in which, when the temperature of the fixing member such as the fixing sleeve 22 detected by the thermopile 35 is below the threshold value, a predetermined constant power is supplied to the excitation coils 31 continuously. The fixing controller 43 selects the temperature control mode in which, when the temperature of the fixing sleeve 22 is above the threshold value, a predetermined power determined based on the temperature of the fixing sleeve 22 detected by the fixing thermopile 35 is supplied to the excitation coils 31. Thus, the fixing controller 43 controls the IH controller 41 based on the selected control mode to perform power supply to the excitation coils 31.

The time when receiving a signal to start power supply to the excitation coils 31 of the induction heating unit 30 means when a user requests printing to the image forming apparatus 1 by manipulating on an operation panel or communicating from a personal computer, and when a start of supplying power to the fixing controller 43 of the fixing control unit 40 in the fixing device 20 is instructed.

When the fixing control unit 40 receives signals such as power ON, return to sleep mode, print job, and the like, for the image forming apparatus 1, the warm-up power supply control to the excitation coils 31 by the power control mode is performed, in which the temperature of the fixing sleeve 22 is raised to a target temperature. In this case, the pressure roller 23 and the fixing sleeve 22 are rotated at the lowest possible speed (i.e., a minimum rotation speed Vmin) to reduce the load on the driving system.

Subsequently, when the temperature of the fixing sleeve 22 reaches the target temperature, it comes to a standby time in which the fixing rotary member such as the fixing sleeve 22, while being rotated, is heated and controlled to keep the target temperature. Controlling the rotation speed of the fixing sleeve 22 and controlling power supply to the excitation coils in the standby time will now be described.

In the standby time, the warming up or activation of the fixing device 20 is completed, the recording medium P is not passed, and the control of the supply of power to the excitation coils 31 and driving control of the pressure roller 23 and the fixing sleeve 22 are being performed so that the temperature of the fixing sleeve 22 is kept at the target temperature (that is, standby mode without sheet passing). The standby mode corresponds to, for example: (1) when a print job is awaited after activation of the fixing device 20; (2) the temperature of the fixing sleeve 22 detected by the fixing thermopile 35 reaches the target temperature, but the temperature of the pressure roller 23 detected by the pressure thermistor 36 does not reach the target temperature, and it is necessary to wait for the temperature of the pressure roller 23 to rise to a predetermined temperature; (3) when the image forming apparatus 1 performs a process control operation; (4) during a long interval between printing jobs; and (5) immediately after the completion of a printing job.

Figure 4A:
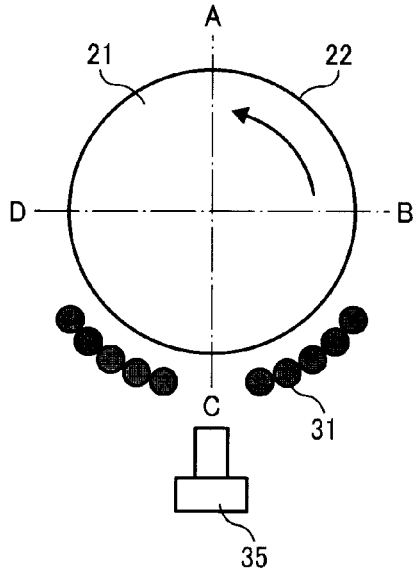
FIG. 4A RELATED ART
FIG. 4A shows relative positions of a fixing thermopile and an excitation coil on an outer circumference of the fixing sleeve and FIG. 4B is a graph showing a relation between the temperature detected by the fixing thermopile and an input power to the excitation coil.
Figure 4B:
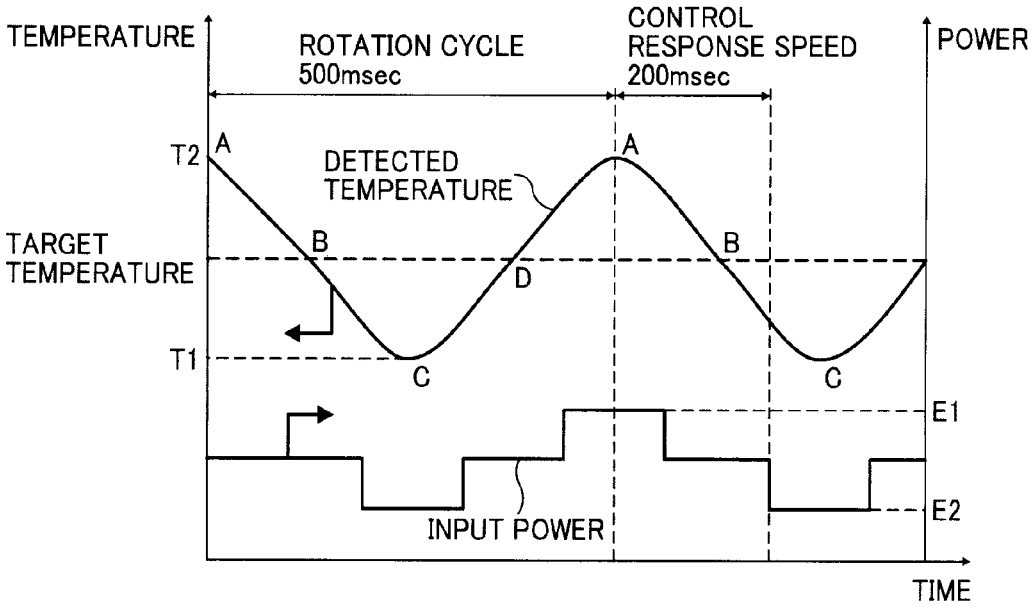
FIG. 4B RELATED ART

Referring to FIG. 4, the power control to the excitation coil 31 in the fixing device 20 will now be described. FIG. 4A is a cross-sectional view showing a relation between the fixing roller 21 or the fixing sleeve 22, the excitation coils 31 and the fixing thermopile 35. FIG. 4B shows a relation between the temperature detected by the fixing thermopile 35 and the input power to the excitation coils 31.

When the temperature of the fixing sleeve 22 in the fixing device 20 reaches the target temperature, supplying power to the excitation coils 31 starts in the temperature control mode. Specifically, the fixing thermopile 35 detects the temperature of the fixing sleeve 22 periodically or continuously, the fixing controller 43 calculates an input power to the excitation coils 31 in accordance with the difference between the temperature of the fixing sleeve 22 detected by the fixing thermopile 35 and the target temperature for the fixing sleeve 22, and the IH controller 41 causes to supply the calculated input power to the excitation coils 31 (that is, the PID feedback control).

Specifically, the following processes are performed.

(Step S11) The fixing thermopile 35 detects a lowest temperature T1 of the fixing sleeve 22 at a certain point such as a point C in FIG. 4A on the circumference of the fixing roller 21 at a time t1.

(Step S12) The fixing controller 43 performs calculation based on the lowest temperature T1 to obtain an input power E1 to the excitation coils 31, and instructs the IH controller 41 to input the power E1.

(Step S13) The IH controller 41 inputs the power E1 to the excitation coils 31 to induction-heat, with the power E1, the fixing sleeve 22 positioned at the point C in FIG. 4A on the outer circumference of the fixing roller 21 at a time t2.

Alternatively, the following operation is performed.

(Step S21) The fixing thermopile 35 detects a highest temperature T2 of the fixing sleeve 22 at a point C in FIG. 4A on the circumference of the fixing roller 21 at a certain time t3.

(Step S22) The fixing controller 43 performs calculation based on the highest temperature T2 to obtain an input power E2 to the excitation coils 31, and instructs the IH controller 41 to input the input power E2.

(Step S23) The IH controller 41 inputs the power E2 to the excitation coils 31 to induction-heat, with the power E2, the fixing sleeve 22 positioned at the point C in FIG. 4A on the circumference of the fixing roller 21 at a time t3.

In this case, when the rotation speed of the fixing sleeve 22 is 2 rps, the fixing sleeve rotates once in 500 msec. The time to taken for the steps S11 to S13 or the steps S21 to S23, which correspond to the control response speed of the ordinary IH method is 200 msec. 200 msec corresponds to a rotation of 144° of the fixing sleeve 22, during which the fixing control unit 40 detects the temperature, performs calculation, and inputs power to the excitation coils 31. Specifically, as illustrated in FIG. 4A, inputting the power E1 corresponding to the lowest temperature of the fixing sleeve 22 detected at the time t1 and at the C point is performed to a portion of the fixing sleeve 22 positioned at a point between the points D and A at the time t1, whereby the proximity of the point having the highest temperature is heated with the power E1 (see FIG. 4B). Similarly, inputting the power E2 corresponding to the maximum temperature of the fixing sleeve 22 at the time t3 and at the point C is performed to a portion of the fixing sleeve 22 positioned at a point between the points D and A at the time t3, whereby the proximity of the point having the lowest temperature is heated with the power E2.

Figure 5:
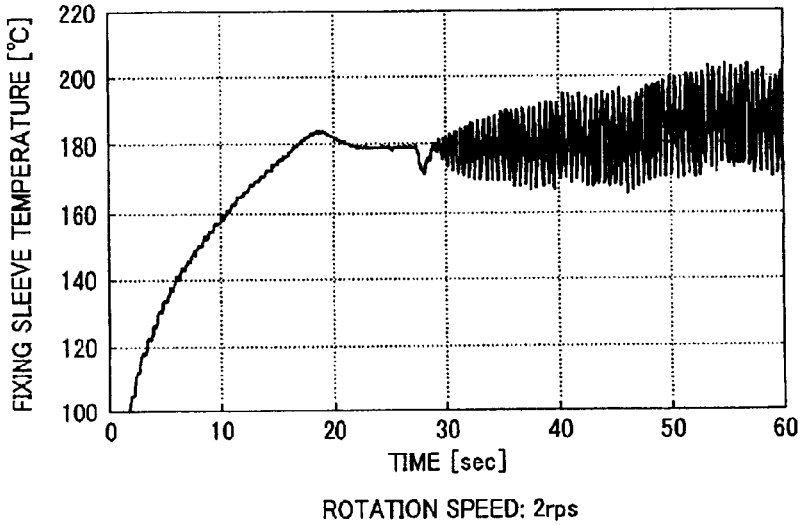
FIG. 5 RELATED ART
FIG. 5 is a view showing a diverging state of the temperature variations on the circumference of the fixing sleeve in the standby mode without sheet passing in the conventional fixing device.

In the conventional fixing device, such power control is continuously performed, and as a result, the fluctuation amplitude in the temperature ripples diverges up to 30 degrees as illustrated in FIG. 5, causing occurrence of uneven glossiness or offset in the formed image.

In order to solve the above problem, the fixing device according to one embodiment of the present invention is configured to change a rotation speed of the fixing sleeve in a standby time in which the fixing sleeve, while rotating, is controlled so as to keep the target temperature when a periodic temperature difference occurs on a circumference of the fixing rotary member having a fluctuation amplitude larger than a predetermined value compared to a target temperature.

Figure 6:
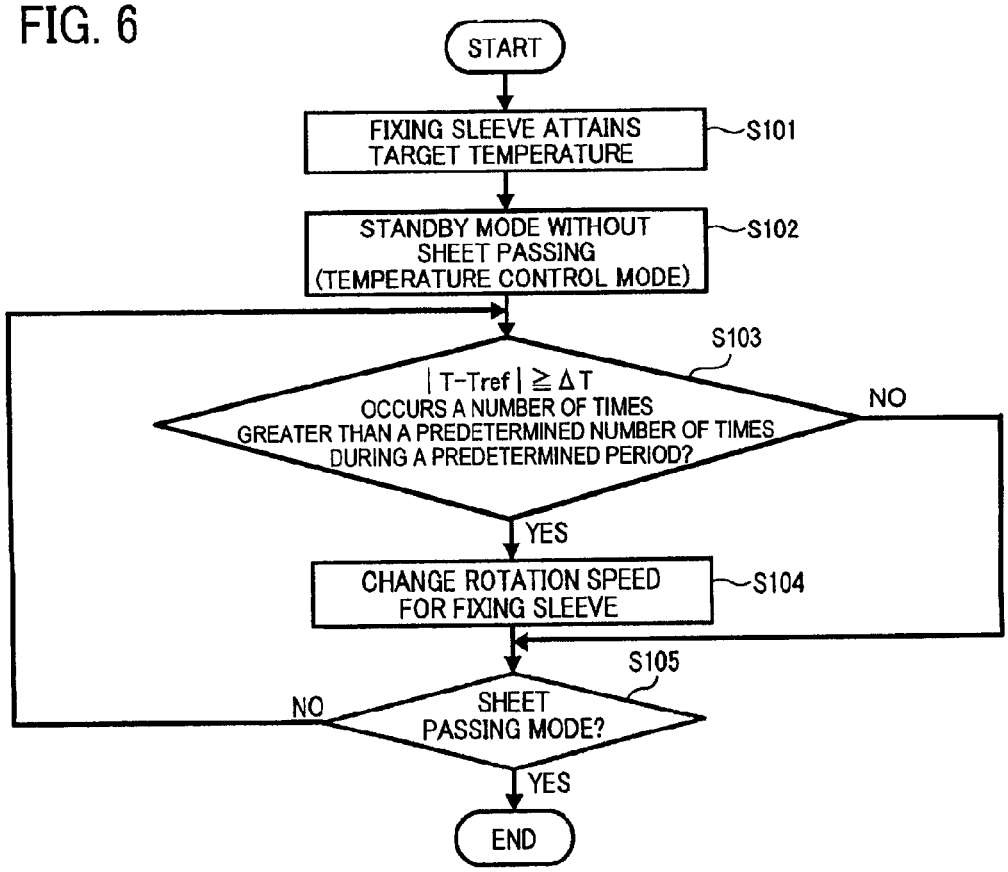
FIG. 6 is a flowchart showing steps in a process of control in the standby mode without sheet passing of the fixing device according to one embodiment of the present invention.

FIG. 6 is a flowchart showing steps in a control process during the standby time, in which the fixing device according to one embodiment of the present invention, while being rotated, is heated and controlled to keep a predetermined target temperature.

(Step S101) When the fixing control unit 40 receives signals such as power ON, return to sleep mode, print job, and the like, for the image forming apparatus 1, control of the supply of power to the excitation coils 3 is performed via the power control mode, and the temperature of the fixing sleeve 22 reaches the target temperature (Tref).

(Step S102) Thereafter, when it comes to be a standby mode without sheet passing, the fixing control unit 40 rotates the fixing sleeve 22 at a predetermined rotation speed (V1) and controls power supply to the excitation coils 31 using the temperature control mode so that the fixing sleeve 22 is controlled to keep the target temperature.

(Step S103) At the same time, the fixing control unit 40 causes the fixing thermopile 35 to detect the temperature T of the rotating fixing sleeve 22 at a certain point (which is a measuring point of the fixing thermopile 35) periodically or continuously during a predetermined period of time. The fixing control unit 40 detects the difference in the periodic uneven temperature or the temperature deviation |T−Tref| on the circumference of the fixing sleeve 22, and determines whether the number of times that the maximum value of the temperature difference |T−Tref| becomes larger than a predetermined difference ΔT exceeds a predetermined number of times during the predetermined period of time. Specifically, it is determined whether the number of times that the following formula (1) is satisfied becomes greater than the predetermined number of times during the predetermined period of time.

$$|T-\mathrm{Tref}|\geq\Delta T \quad (1)$$

The maximum value of the temperature difference |T−Tref| means the difference between the highest temperature Tmax or the lowest temperature Tmin of the fixing sleeve 22 and the target temperature Tref. The predetermined difference ΔT is preferably 10 degrees or less and more preferably 5 degrees or less. The predetermined number of times may be once, but twice or more is preferable to prevent erroneous detection.

(Step S104) When the above formula (1) is satisfied, that is, the answer is yes, the fixing controller 43 adjusts driving of the drive motor 23*m* and changes the rotation speed of the fixing sleeve 22 from the rotation speed V1 to another rotation speed V2. According to this, the position on the rotating fixing sleeve 22 to which the induction heating is performed in the steps S11 to S12 or the steps S21 to 23 is changed, whereby the position to perform the induction heating with the power E1 is not the position with the lowest temperature Tmin and the fluctuation amplitude in the temperature ripples on the fixing sleeve 22 is suppressed.

After the rotation speeds of the pressure roller 23 and the fixing sleeve 22 are changed, it is determined whether the sheet passing mode in which the fixing process is to be performed is instructed or not (in step S105). If the instruction of the sheet passing mode does not exist (No in step S105), the process returns to the step S103 to repeatedly determine whether the formula (1) is satisfied or not. If there is an instruction of the sheet passing mode (Yes in S105), the process flow as illustrated in FIG. 6 terminates and the process moves to a control mode necessary to the fixing process.

When the answer is No in Step S103, the rotation speeds of the pressure roller 23 and the fixing sleeve 22 are not changed, and it is determined whether the sheet passing mode in which the fixing process is to be performed is instructed or not (in step S105). If the instruction of the sheet passing mode does not exist (No in step S105), the process returns to the step S103 to repeatedly determine whether the formula (1) is satisfied or not. If there is an instruction of the sheet passing mode (Yes in S105), the process flow as illustrated in FIG. 6 terminates and the process moves to a control mode necessary to the fixing process.

The change in the rotation speeds of the pressure roller 23 and the fixing sleeve 22 may be either to decrease/slower the rotation speed V1 before the change or to increase/accelerate the rotation speed V1 before the change.

In this case, when the rotation speed V1 before the change corresponds to a speed for the fixing process, to increase/accelerate the rotation speed is not preferable since this requires improvements to the performance of the drive system of the fixing device 20.

In order to lessen the fluctuation amplitude in the temperature ripples of the fixing sleeve 22, the rotation cycle of the fixing sleeve 22 basically is adjusted so as to lower the rotation of the fixing sleeve 22. By contrast, the accumulated heat in the pressure roller 23 needs to be considered to reduce the temperature drop at a time of sheet passing start and to enable an immediate fixing operation in the non-sheet passing mode. Then, the rotation of the fixing sleeve 22 and the pressure roller 23 is increased so that a certain amount of heat may be transmitted from the fixing sleeve 22 to the pressure roller 23. In the present embodiment, the change in the rotation speed of the fixing sleeve 22 is preferably within a range capable of accumulating heat in the pressure roller 23 while satisfactorily suppressing the fluctuation amplitude in the temperature ripples of the fixing sleeve 22.

Accordingly, the rotation speeds of the pressure roller 23 and the fixing sleeve 22 can be changed at once or may be changed gradually over time to attain the target temperature.

The rotation speed of the fixing sleeve 22 is preferably changed to satisfy the following formula (2):

$$S>L\times 4 \quad (2)$$

in which S (sec) is a rotation cycle of the fixing sleeve 22, and L (sec) is a response speed required to the steps S11 to S13 or the steps S21 to S23. Accordingly, the rotation cycle of the fixing sleeve 22 becomes longer than four times the response speed in the heating control, whereby heating is performed at a proximate position within a rotation angle of +90° on the circumference of the fixing sleeve 22 with respect to the temperature detecting position at 0° of the fixing thermopile 35, thereby enabling reduction of the fluctuation amplitude in the temperature ripples.

Alternatively, a plurality of rotation speeds is previously set as control rotation speeds in the fixing device 20, and a suitable rotation speed may be selected from the plurality of speeds and is used to change the rotation speed of the fixing sleeve 22. This method only needs to change the rotation speed of the fixing sleeve 22 to another one previously set for the fixing sleeve 22 and, without any drastic change or modification in the driving system, the fluctuation amplitude in the temperature ripples in the fixing sleeve 22 can be restricted.

Specifically, the fixing device 20 is configured such that the rotation speed of the fixing sleeve 22 in the fixing device 20 is so configured as to be set at the lowest rotation speed Vmin in the warming-up time. During the fixing operation, the fixing sleeve 22 is configured to have a plurality of rotation speeds, according to the sheet type and thickness of the recording medium P, including the highest rotation speed Vmax and at least one intermediate rotation speed Vn being the value between the highest rotation speed Vmax and the lowest rotation speed Vmin. The plurality of rotation speeds are set as control rotation speeds. More specifically, the highest rotation speed, the rotation speed corresponding to a thick sheet of a recording medium P, and the rotation speed in the warming-up time are set to satisfy a relation: Vmax: ½ Vmax:¼ Vmax.

A change in the rotation speed of the fixing sleeve 22 is preferably performed as follows. For example, in a case where the rotation speed V1 of the fixing sleeve 22 before the change is the lowest rotation speed Vmin, the rotation speed V2 after the change preferably is either the intermediate transfer speed Vn or the highest rotation speed Vmax. Specifically, since in the following three cases the fixing sleeve 22 is driven to rotate at the warming-up time rotation speed ¼ Vmax, the rotation speed of the fixing sleeve 22 preferably is changed to either Vmax or ½ Vmax. (1) When waiting for a print job after activation of the fixing device 20; (2) the temperature of the fixing sleeve 22 detected by the fixing thermopile 35 attains a target temperature, but the temperature of the pressure roller 23 detected by the pressure thermistor 36 does not reach a predetermined temperature and still waiting for the pressure roller 23 to attain the predetermined temperature; and (3) during when the process control in the image forming apparatus 1 is being performed.

When the rotation speed V1 of the fixing sleeve 22 before the change is Vmax, the rotation speed V2 of the fixing sleeve 22 after the change is preferably changed to either Vn or Vmin. Specifically, in the following cases (2) to (5), the fixing sleeve 22 is first driven to rotate at the rotation speed of Vmax for the fixing operation, and the rotation speed of the fixing sleeve 22 is preferably changed to ½ Vmax or ¼ Vmax. (2) The temperature of the fixing sleeve 22 detected by the fixing thermopile 35 attains a target temperature, but the temperature of the pressure roller 23 detected by the pressure thermistor 36 does not reach a predetermined temperature and it is still necessary to wait for the pressure roller 23 to attain the predetermined temperature; (3) during when the process control in the image forming apparatus 1 is being performed; (4) in a long interval between print jobs; and (5) immediately after the completion of a print job.

Figure 7:
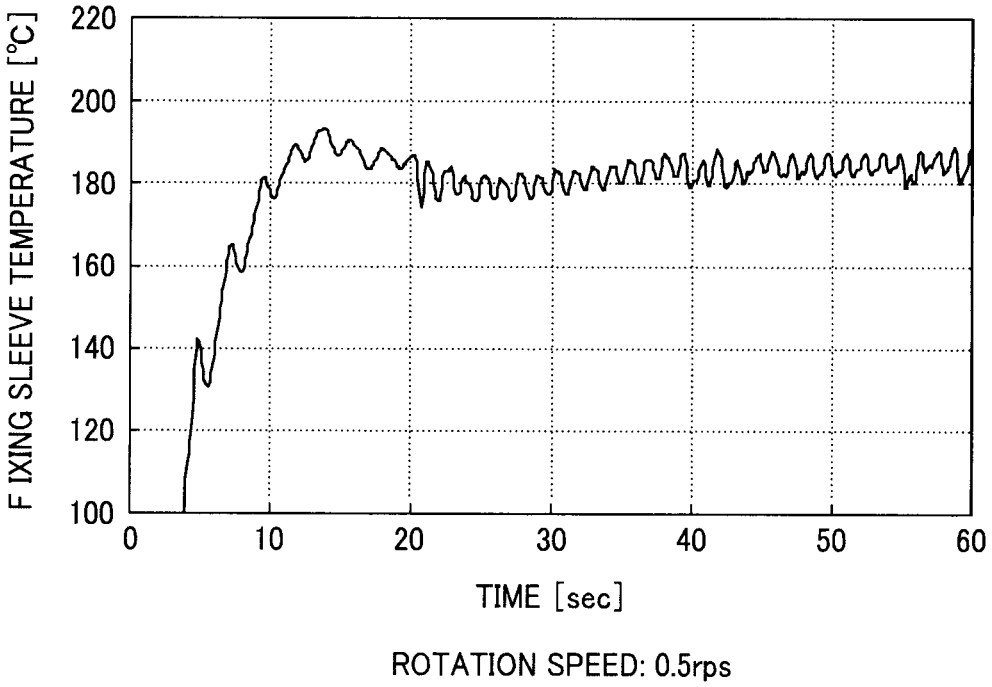
FIG. 7 is a view showing a diverging state of the temperature variations on the circumference of the fixing sleeve in the standby mode without sheet passing in the fixing device according to one embodiment of the present invention.

FIG. 7 shows change in the temperature of the fixing sleeve 22 when the rotation speed change control of the fixing sleeve 22 is performed in the standby mode without sheet passing of the fixing device according to the embodiment of the present invention.

As illustrated in FIG. 5, when the rotation speed of the fixing sleeve 22 is 2 rps, the temperature ripples of the fixing sleeve 22 tend to diverge. The above tendency can be detected from a result that the frequency satisfying the formula (1) ($\Delta T$=5 degrees) is twice or more in the predetermined period of time, and the rotation speed of the fixing sleeve 22 is changed to 0.5 rps. According to this, the fixing sleeve 22 rotates once at a speed of 2000 msec. Since the control response speed is 200 msec, the fixing sleeve 22 rotates 36° during when the fixing control unit 40 detects the temperature, performs calculation and supplies electric current to the excitation coils 31. Accordingly, the power E1 corresponding to the lowest temperature of the fixing sleeve 22 detected at the point C at time t1 as illustrated in FIG. 4A is input to the fixing sleeve 22 positioned between the points C and D at time t1, whereby an area near the position of the lowest temperature is heated. Similarly, the power E2 corresponding to the highest temperature of the fixing sleeve 22 detected at the point C at time t3 is input to the fixing sleeve 22 positioned between the points C and D at time t3, whereby an area near the position of the highest temperature is heated. As a result, as illustrated in FIG. 7, the diverging of the temperature fluctuation in the circumferential direction of the fixing sleeve 22 is restricted, thereby suppressing the fluctuation amplitude of the temperature ripples within 5 degrees.

The above technique can be applied to the present invention regardless of the relative positions of the induction heating unit 30 or excitation coils 31 and the fixing thermopile 35 on the circumference of the fixing roller 21.

Referring now to FIG. 8, a change to the rotation speed of the fixing sleeve 22 will now be described based on the structure of the fixing device 20 as described with reference to FIG. 2.

Figure 8A:
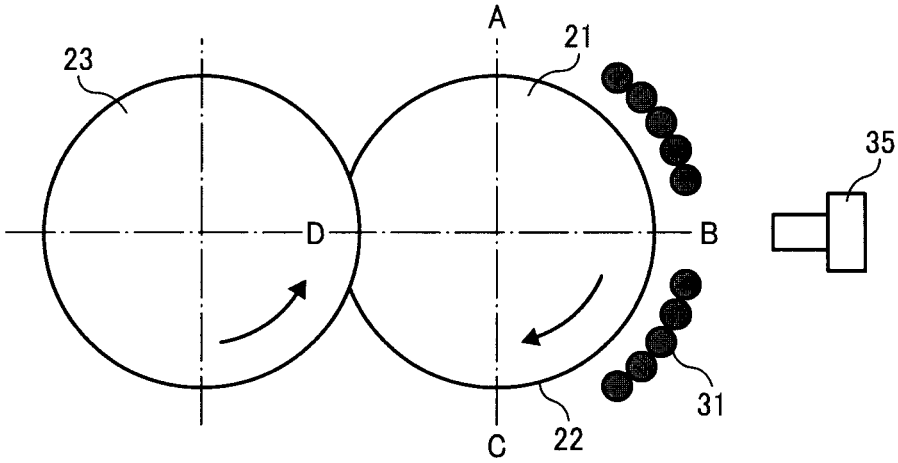
FIG. 8A shows relative positions of an excitation coil, a fixing thermopile, and a nip portion.

FIG. 8A is a schematic view illustrating relative positions of the excitation coils 31, the fixing thermopile 35, and the nip portion in the structure of FIG. 2. In this case, the excitation coils 31 and the fixing thermopile 35 are at the same position (point B) on the outer circumference of the fixing roller 21. The excitation coils 31 heat a certain longitudinal area on the circumference of the fixing sleeve 22, and herein it is assumed that the excitation coils 31 are positioned at a center point in the certain longitudinal area on the circumference thereof.

In general, the temperature distribution on the circumference of the fixing sleeve 22 is such that the highest temperature and the lowest temperature alternatively appear with a rotational interval of 180° (that is, positions opposite to each other in FIG. 8A). For example, the lowest temperature appears at the point B in the figure and the highest temperature appears at the point D (at the nip position). By contrast, the highest temperature is at the point B and the lowest temperature is at the point D.

In the thus configured structure, if there is a delay in time in a rotation of 180° after the fixing thermopile 35 detects the temperature of the fixing sleeve 22 at the point B and starts heating the fixing sleeve 22, the temperature difference on the circumference of the fixing sleeve 22 diverges and the fluctuation amplitude in the temperature ripples becomes maximum.

Figure 8B:
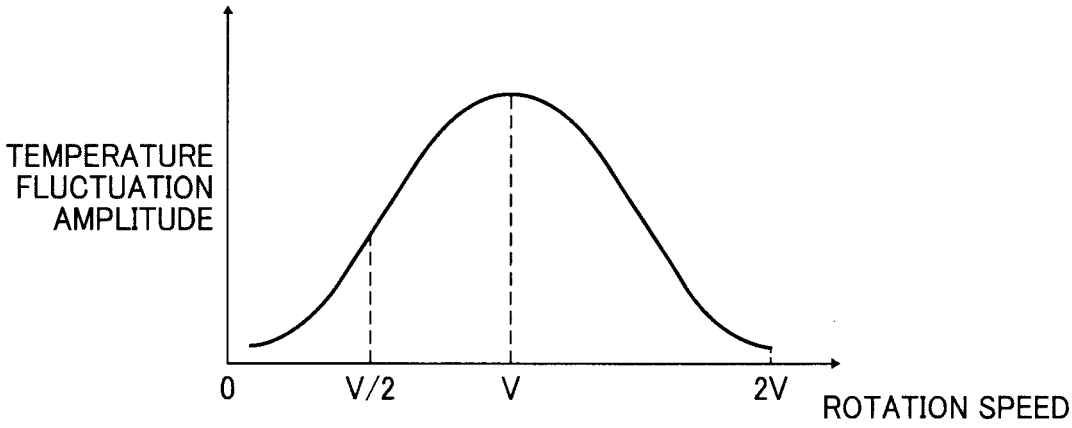
FIG. 8B shows a relation between the rotational speed of the fixing speed and the fluctuation amplitude in the temperature ripples.

Assuming that the rotation speed of the fixing sleeve 22 in the above case is set to be V, the fluctuation amplitude in the temperature ripples may be lowered by slowing the rotation speed of the fixing sleeve 22 or by quickening it as illustrated in FIG. 8B. When the rotation speed of the fixing sleeve 22 is quickened to 2V, the temperature detecting position and the heating position of the fixing sleeve 22 coincide, thereby making the fluctuation amplitude of the temperature ripples smallest.

Referring now to FIG. 9, how the rotation speed of the fixing sleeve 22 is changed will now be described.

Figure 9A:
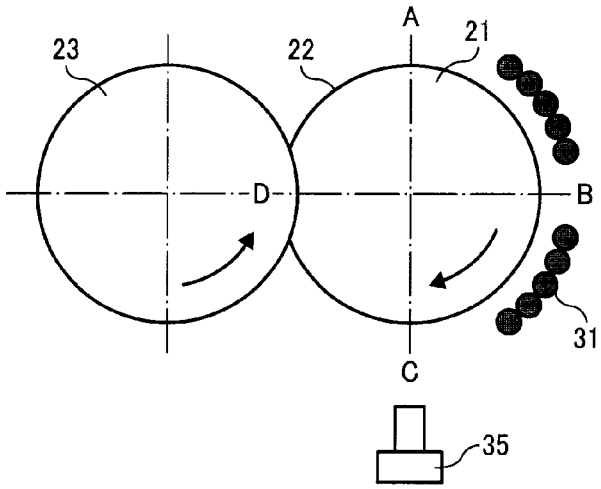
FIG. 9A shows relative positions of an excitation coil, a fixing thermopile, and a nip portion.

FIG. 9A is a schematic view illustrating relative positions of the excitation coils 31, the fixing thermopile 35, and the nip portion in the modified structure of FIG. 2. In this case, the excitation coils 31 is positioned at the point B opposite the point D (nip portion), and the fixing thermopile 35 is at the point C which is in between the point B where the excitation coils 31 are provided and the nip portion (point D).

In this case also, the temperature distribution on the circumference of the fixing sleeve 22 is such that the highest temperature and the lowest temperature alternatively appear with a rotational interval of 180° (that is, positions opposite to each other in FIG. 9A). For example, the lowest temperature appears at the point C in the figure and the highest temperature appears at the point A. By contrast, the highest temperature is at the point C and the lowest temperature is at the point A.

In the thus-configured structure, if there is a delay in time in a rotation of 90° after the fixing thermopile 35 detects the temperature of the fixing sleeve 22 at the point B and starts heating the fixing sleeve 22, the temperature difference on the circumference of the fixing sleeve 22 diverges and the fluctuation amplitude in the temperature ripples becomes maximum.

Figure 9B:
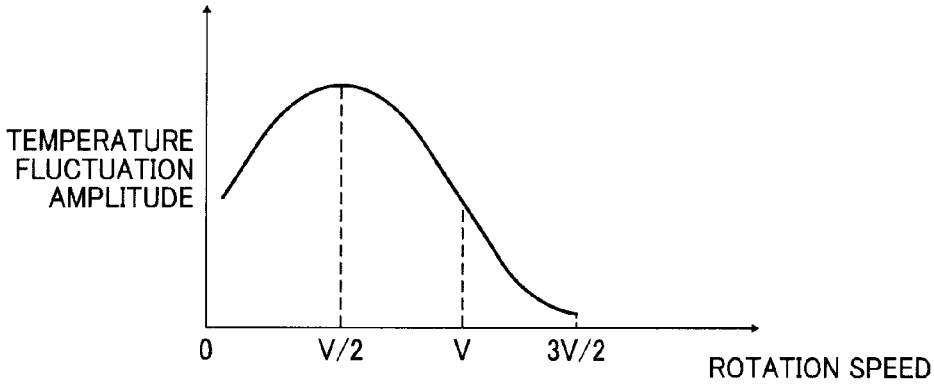
FIG. 9B shows a relation between the rotational speed of the fixing speed and the fluctuation amplitude in the temperature ripples.

Assuming that the rotation speed of the fixing sleeve 22 in the above case is set to be V/2, the fluctuation amplitude in the temperature ripples may be lowered by slowing the rotation speed of the fixing sleeve 22 or by quickening it as illustrated in FIG. 9B. When the rotation speed of the fixing sleeve 22 is quickened to 3V/2, the temperature detecting position and the heating position of the fixing sleeve 22 coincide, thereby minimizing the fluctuation amplitude of the temperature ripples.

What is described in the above embodiment relates to changing the rotation speed of the fixing rotary member when periodic temperature ripples occur having a fluctuation amplitude exceeding the predetermined value compared to the target temperature on the circumference of the fixing rotary member during the standby time while rotating and controlling the fixing rotary member to keep the target temperature. Alternatively, instead of changing the rotation speed of the fixing rotary member, the response speed of the temperature control of the fixing rotary member may be changed. Specifically, one half cycle rotation of the fixing rotary member or the fixing sleeve 22 and the control response speed (time required for steps S11 to S13 and S21 to S23) are made inconsistent with each other so that the fluctuation amplitude of the temperature ripples in the fixing sleeve 22 is restricted.

Specifically, in the control flow of FIG. 6, if the response in Step S103 is yes, the rotation cycle S (sec) of the fixing sleeve is not changed and the control response speed L (sec) is delayed to satisfy the following equation (3):

$$L=S \tag{3}$$

More specifically, in Steps S12 and S22, the timing to instruct inputting power calculated by the fixing controller 43 to the IH controller 41 is delayed. Alternatively, controlling so that L=2S or L=3S can be considered, but they are not preferable because the heating timing is excessively delayed.

By heating the fixing sleeve 22 at +360°, that is, at a timing delayed by one cycle of rotation from the temperature detecting position of 0° of the fixing thermopile 35, the temperature detecting position and the heating position may be matched, thereby effectively damping the temperature ripples.

In addition, when periodic temperature ripples occur having fluctuation amplitude exceeding the predetermined value compared to the target temperature on the circumference of the fixing rotary member during the standby time while rotating and controlling the fixing rotary member to keep the target temperature, instead of changing the rotation speed of the fixing rotary member, the power control in the temperature control mode may be changed from the feedback control to the feed forward control. Specifically, in order to perform the PID feedback control to the temperature detected by the fixing thermopile 35, there is occurred a control response speed. By changing the power control to the feed forward control, the power may be controlled without any delay in control.

Specifically, in the control flow of FIG. 6, when the response in Step S103 is yes, the rotation cycle S (sec) of the fixing sleeve 22 is not changed. Instead, power supply to the excitation coils 31 is made constant and the feed forward control is performed. That is, in the fixing device 20 as illustrated in FIG. 2, a constant power supply of from 300 to 400 watts being the energy consumption when the fixing sleeve 22 is kept at 160° is input to the fixing sleeve 22, and the temperature difference on the circumference of the fixing sleeve 22 is converged due to the thermal diffusion of the fixing roller 21, the fixing sleeve 22, and the pressure roller 23.

Alternatively, in order to prevent the temperature of the fixing sleeve 22 from gradually deviating from the target temperature, the input power to the fixing sleeve 22 may be corrected based on the temperature of the fixing sleeve 22 periodically detected by the fixing thermopile 35.

By this method, the temperature ripples during the standby time without sheet passing operation may be damped while minimizing the heat accumulating speed or the temperature damping at a time of starting sheet passing operation.

In the above explanation of the embodiment, the excitation coils 31 are provided on the outer circumference of the fixing sleeve 22 supported by the fixing roller 21. The present invention is not limited to the above structure, and the fixing sleeve 22 can be heated from an inner circumference thereof by a ceramic heater provided inside the fixing sleeve 22.

Figure 10:
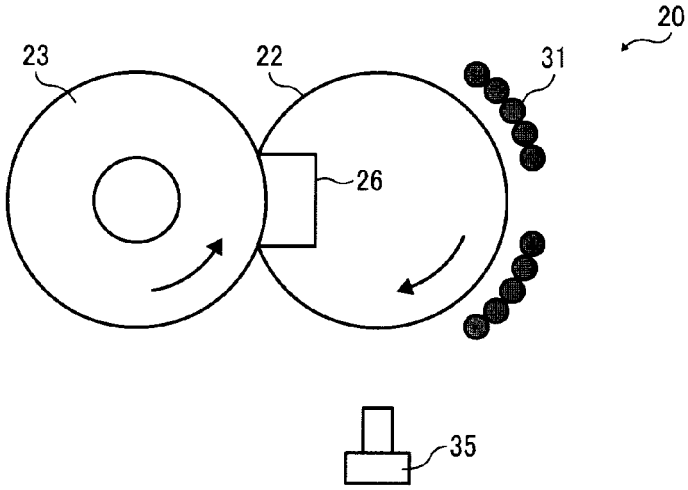
FIG. 10 is a cross-sectional view showing a structure of the fixing device according to another embodiment of the present invention.

As illustrated in FIG. 10, the fixing device 20 according to one embodiment of the present invention may include: an endless belt-shaped rotatable fixing sleeve 22 having a heating layer; a pressure roller 23, as a drive roller, provided in contact with the outer circumference of the fixing sleeve 22; an elastic contact member 26 forming a nip portion while contacting the pressure roller 23 via the fixing sleeve 22; a temperature thermopile 35 to detect the temperature of the fixing sleeve 22, and excitation coils 31 configured to induction-heat the heating layer of the fixing sleeve 22 based on the result of the temperature detection by the temperature thermopile 35.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a fixing rotary member having a heating layer;

a pressure rotary member configured to form a nip while contacting the fixing rotary member and rotate to drive the fixing rotary member;

a temperature detector to detect a temperature on a circumference of the fixing rotary member; and an excitation coil provided near the fixing rotary member and configured to induction-heat the heating layer of the fixing rotary member based on a detection result from the temperature detector, wherein, when the fixing device is in a standby time during which time the fixing rotary member continues to rotate, a rotation speed of the fixing rotary member is changed and controlled to maintain a target temperature when a periodic temperature difference, occurring on the circumference of the fixing rotary member, has a fluctuation amplitude larger than a predetermined value compared to the target temperature, wherein the rotation speed of the fixing rotary member is changed in a standby time in which the fixing rotary member, while rotating, is heated and controlled to maintain a target temperature when a detected temperature T of the fixing rotary member detected by the temperature detector attains a target temperature Tref for the fixing rotary member, and a number of times that formula (1) is satisfied exceeds a predetermined number during a predetermined time period:

$$|T-Tref|\geq\Delta T, \tag{1}$$

where ΔT is a predetermined difference in the temperature, wherein the rotation speed of the fixing rotary member is changed so as to satisfy a relation S>L×4, and wherein S (sec) is a rotation cycle of the fixing rotary member, and L (sec) is a response speed for heating control of the fixing rotary member.

2. The fixing device as claimed in claim 1, wherein the temperature detector periodically or continuously detects the temperature of the fixing rotary member at a fixed point relative to the rotating fixing rotary member, thereby detecting the periodic temperature difference on an outer circumference of the fixing rotary member.

3. The fixing device as claimed in claim 1, wherein the fixing rotary member has at least three control rotation speeds including a highest rotation speed Vmax, a lowest rotation speed Vmin, and at least one intermediate rotation speed Vn between the highest rotation speed Vmax and the lowest rotation speed Vmin, and the rotation speed of the fixing rotary member is changed to Vn or Vmax when the rotation speed thereof before change is Vmin.

4. The fixing device as claimed in claim 1, wherein the fixing rotary member has at least three control rotation speeds including a highest rotation speed Vmax, a lowest rotation speed Vmin, and at least one intermediate rotation speed Vn between the highest rotation speed Vmax and the lowest rotation speed Vmin, and the rotation speed of the fixing rotary member is changed to Vn or Vmin, when the rotation speed thereof before change is Vmax.

5. The fixing device as claimed in claim 1, wherein the excitation coil is disposed partially around an outer perimeter of the fixing rotary member.

6. The fixing device as claimed in claim 1, further comprising a degaussing coil disposed adjacent to the excitation coil.

7. An image forming apparatus, comprising:

a fixing device including:

a fixing rotary member having a heating layer, a pressure rotary member configured to form a nip while contacting the fixing rotary member and rotate to drive the fixing rotary member, a temperature detector to detect a temperature on a circumference of the fixing rotary member, and an excitation coil provided near the fixing rotary member and configured to induction-heat the heating layer of the fixing rotary member based on a detection result from the temperature detector, wherein, when the fixing device is in a standby time during which time the fixing rotary member continues to rotate, a rotation speed of the fixing rotary member is changed and controlled to maintain a target temperature when a periodic temperature difference, occurring on the circumference of the fixing rotary member, has a fluctuation amplitude larger than a predetermined value compared to the target temperature, wherein the rotation speed of the fixing rotary member is changed in a standby time in which the fixing rotary member, while rotating, is heated and controlled to maintain a target temperature when a detected temperature T of the fixing rotary member detected by the temperature detector attains a target temperature Tref for the fixing rotary member, and a number of times that formula (1) is satisfied exceeds a predetermined number during a predetermined time period:

$$|T-T\mathrm{ref}|\geq\Delta T, \quad (1)$$

where ΔT is a predetermined difference in the temperature, wherein the rotation speed of the fixing rotary member is changed so as to satisfy a relation S>L×4, and wherein S (sec) is a rotation cycle of the fixing rotary member, and L (sec) is a response speed for heating control of the fixing rotary member.

* * * * *